US009528348B2

(12) United States Patent
Miller

(10) Patent No.: US 9,528,348 B2
(45) Date of Patent: Dec. 27, 2016

(54) METHOD AND SYSTEM FOR DRIVING A DOWNHOLE POWER UNIT

(71) Applicant: Halliburton Energy Services, Inc., Houston, TX (US)

(72) Inventor: Todd B. Miller, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 284 days.

(21) Appl. No.: 14/112,137

(22) PCT Filed: Oct. 26, 2012

(86) PCT No.: PCT/US2012/062155

§ 371 (c)(1),
(2) Date: Oct. 16, 2013

(87) PCT Pub. No.: WO2014/065820

PCT Pub. Date: May 1, 2014

(65) Prior Publication Data

US 2014/0116730 A1 May 1, 2014

(51) Int. Cl.

| | |
|---|---|
| ***E21B 49/00*** | (2006.01) |
| ***E21B 41/00*** | (2006.01) |
| ***E21B 23/06*** | (2006.01) |

(52) U.S. Cl.

CPC ..... *E21B 41/00* (2013.01); *E21B 23/06* (2013.01)

(58) Field of Classification Search

CPC ..... E21B 1/00; E21B 1/02; E21B 1/04; E21B 10/36; E21B 41/00; E21B 6/00; E21B 4/06; E21B 4/00; E21B 6/02; E21B 6/04; E21B 6/06; E21B 6/08; E21B 23/06; E21B 23/00

See application file for complete search history.

(56) References Cited

U.S. PATENT DOCUMENTS

| | | | | |
|---|---|---|---|---|
| 4,651,837 | A * | 3/1987 | Mayfield | E21B 10/66 175/260 |
| 5,871,051 | A * | 2/1999 | Mann | E21B 43/121 166/105 |
| 6,179,055 | B1 | 1/2001 | Sallwasser et al. | |
| 2005/0056427 | A1 | 3/2005 | Clemens et al. | |
| 2008/0217038 | A1* | 9/2008 | Crooks | E21B 6/00 173/97 |
| 2009/0095466 | A1 | 4/2009 | Obrejanu | |

(Continued)

FOREIGN PATENT DOCUMENTS

| | | |
|---|---|---|
| EP | 0730083 A2 | 9/1996 |

OTHER PUBLICATIONS

International Search Report and Written Opinion issued in related PCT application No. PCT/US2012/062155, mailed on Jul. 7, 2013 (8 pages).

(Continued)

*Primary Examiner* — Yong-Suk (Philip) Ro
(74) *Attorney, Agent, or Firm* — Scott Richardson; Baker Botts L.L.P.

(57) ABSTRACT

A method and apparatus for setting a subsurface device in a wellbore. A downhole power unit comprises a power rod and a drive shaft. The power rod comprises a hollow interior. The drive shaft is located within the hollow interior, and the power rod is operable to selectively engage a subsurface device to be positioned downhole.

18 Claims, 2 Drawing Sheets

(56) References Cited

U.S. PATENT DOCUMENTS

| | | | | |
|---|---|---|---|---|
| 2009/0194284 | A1* | 8/2009 | Jahn | E21B 4/04<br>166/298 |
| 2011/0147091 | A1* | 6/2011 | Bullin | E21B 4/006<br>175/107 |

OTHER PUBLICATIONS

International Preliminary Report on Patentability issued in related PCT Application No. PCT/US2012/062155, mailed on May 7, 2015 (6 pages).

* cited by examiner

METHOD AND SYSTEM FOR DRIVING A DOWNHOLE POWER UNIT

CROSS-REFERENCE TO RELATED APPLICATION

This application is a U.S. National Stage Application of International Application No. PCT/US2012/062155 filed Oct. 26, 2012, and which is hereby incorporated by reference in its entirety.

BACKGROUND

After drilling a wellbore that intersects a subterranean hydrocarbon-bearing formation, a variety of wellbore tools may be positioned in the wellbore during completion, production, or remedial activities. For example, temporary packers may be set in the wellbore during the completion and production operating phases of the wellbore. In addition, various operating tools including flow controllers (e.g., chokes, valves, etc.) and safety devices such as safety valves may be releasably positioned in the wellbore.

A number of subsurface wellbore devices such as plugs, safety valves, packers, and the like may be used when performing subterranean operations. Such tools are generally lowered downhole by either a wireline or a working string and may be configured with a fishing neck to facilitate recovery at a later time. Once downhole, the tool may be set at a desired location and released, allowing the wireline or work string to be retrieved.

The setting and retrieving of such tools may be performed mechanically by a work string or wireline or by electrically actuated power units. Electrically actuated power units may utilize a conductor in the wireline to accomplish actuation by surface power, after the tool is properly positioned. Alternatively, self-contained Downhole Power Units ("DPUs") which do not require electrical power from the surface and therefore permit using a slickline rather than a wireline may be used. The use of DPUs is desirable because of their relative speed and efficiency of use.

However, because DPUs are not powered from the surface, they can only apply a limited amount of force. Further, conventional DPUs are relatively long to prevent exposure of parts to wellbore pressure. It is desirable to develop a more compact DPU that can provide greater force than that supplied by traditional DPUs.

BRIEF DESCRIPTION OF THE DRAWING(S)

The present disclosure will be more fully understood by reference to the following detailed description of the preferred embodiments of the present disclosure when read in conjunction with the accompanying drawings, in which like reference numbers refer to like parts throughout the views, wherein.

The disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes which come within the meaning and range of equivalency of the claims are therefore intended to be embraced therein.

DETAILED DESCRIPTION OF THE DISCLOSURE

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples," as used herein are intended to mean either an indirect or a direct connection. Thus, if a first device couples to a second device, that connection may be through a direct connection, or through an indirect electrical or mechanical connection via other devices and connections. The term "upstream" as used herein means along a flow path towards the source of the flow, and the term "downstream" as used herein means along a flow path away from the source of the flow. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil wellbore. The terms also encompass drilling natural gas wellbores or hydrocarbon wellbores in general. Further, such wellbores can be used for production, monitoring, or injection in relation to the recovery of hydrocarbons or other materials from the subsurface. This could also include geothermal wellbores intended to provide a source of heat energy instead of hydrocarbons.

Figure 1A:
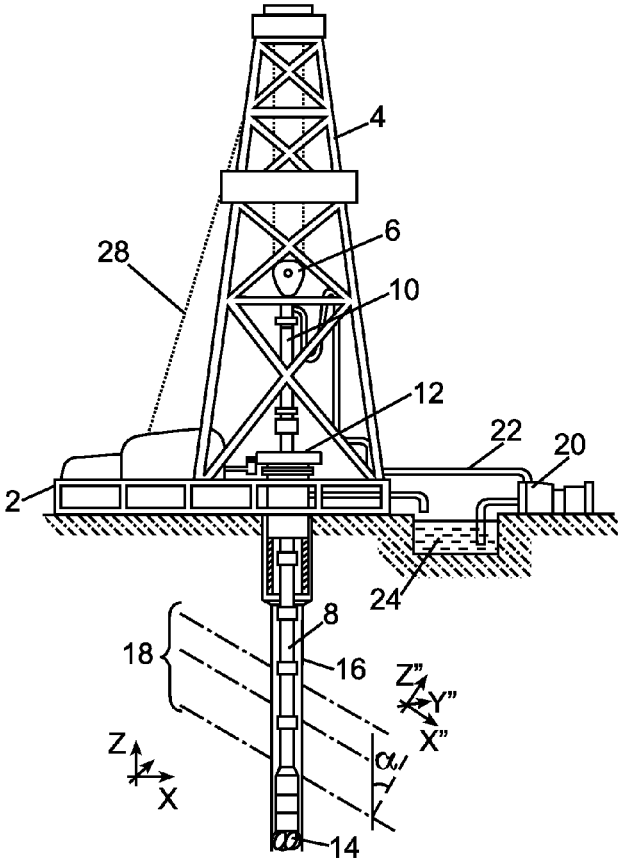
FIG. 1A depicts a wellbore drilling environment in accordance with an embodiment of the present disclosure.

Turning now to FIG. 1A, oil well drilling equipment used in an illustrative drilling environment is shown. A drilling platform 2 supports a derrick 4 having a traveling block 6 for raising and lowering a drill string 8. A kelly 10 supports the drill string 8 as it is lowered through a rotary table 12. A drill bit 14 is driven by a downhole motor and/or rotation of the drill string 8. As bit 14 rotates, it creates a wellbore 16 that passes through various formations 18. A pump 20 may circulate drilling fluid through a feed pipe 22 to kelly 10, downhole through the interior of drill string 8, through orifices in drill bit 14, back to the surface via the annulus between the drill string 8 and the wellbore 16 wall, and into a retention pit 24. The drilling fluid transports cuttings from the borehole into the pit 24 and aids in maintaining the borehole integrity.

Figure 1B:
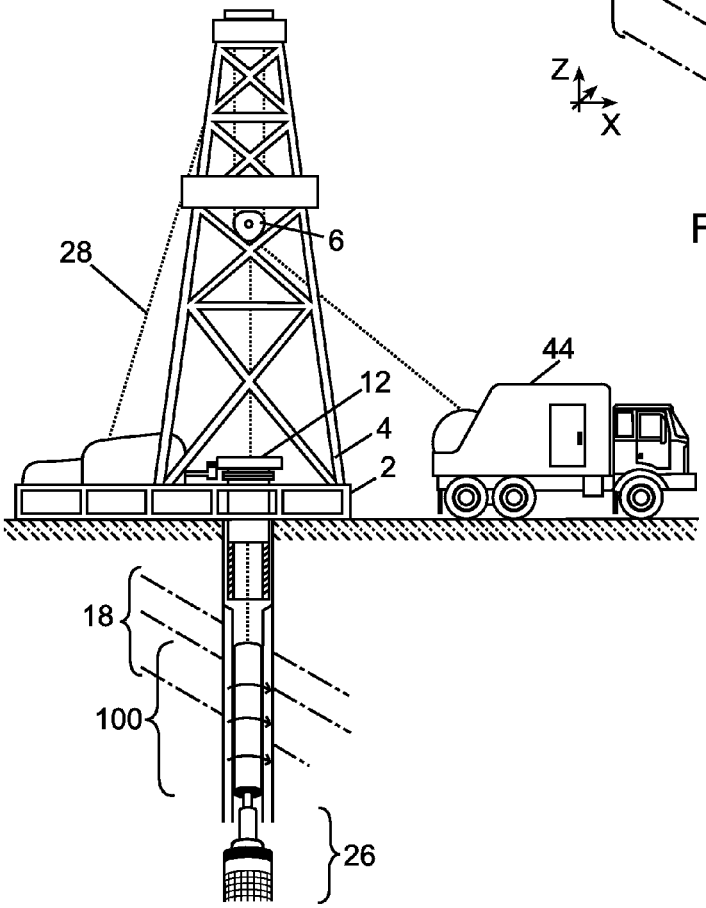
FIG. 1B depicts a DPU being inserted into a wellbore in accordance with an embodiment of the present disclosure.

At various times during the drilling process, the drill string 8 may be removed from the wellbore 16. Once the drill string has been removed, a subsurface device 26 (e.g., a plug, packer, etc.) may be coupled to a DPU 100 and lowered downhole to the desired setting depth via a conveying member 28 as shown in FIG. 1B. A timer initiates this operation. The conveying member 28 may be a slickline, wireline, coil tubing, joint tubing, or braided line. The subsurface device 26 may be used, for example, to seal off or isolate zones inside the wellbore 16. Once the subsurface device 26 reaches the desired location within the wellbore 16, the DPU 100 sets it in place via a process described in more detail below. Once the subsurface device 26 is securely set in place, the DPU 100 may be retrieved by the operator using the conveying member 28 or any other suitable means.

Figure 2A:
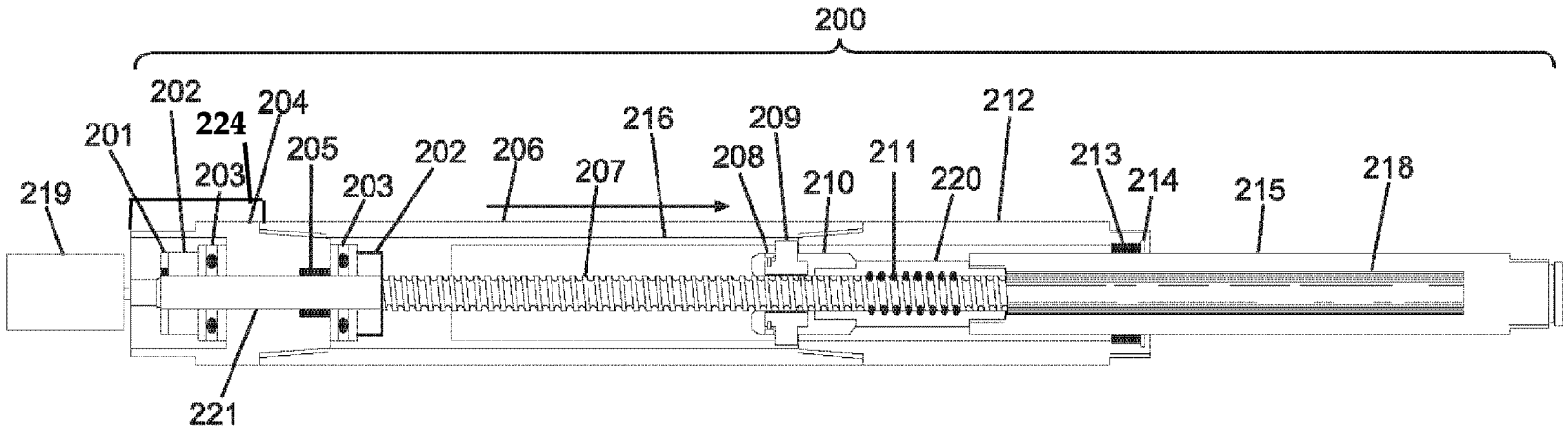
FIG. 2A depicts a DPU in accordance with an embodiment of the present disclosure in an extended position.

Referring now to FIG. 2A, a cross-sectional view of a DPU in accordance with certain embodiments of the present disclosure is denoted generally with reference numeral 200.

As illustrated in FIG. 2A, the DPU 200 may include a guide housing 206 with a drive shaft 207 located therein. A first end of the drive shaft 207 may be rotatably coupled to a motor 219 as discussed in further detail below. A second end of the drive shaft 207 located downhole relative to the first end, may be coupled to a power rod 215. In one embodiment, at least a portion of the drive shaft 207 may be threaded and may be coupled to a hollow interior 218 of the power rod 215 with a threaded engagement. Specifically, the power rod 215 may include a ball nut assembly 211. In accordance with the illustrative embodiment of FIGS. 2A and 2B, the ball nut assembly 211 and the threads of the drive shaft 207 may form the female portion and male portion, respectively, of a threaded connection. Consequently, the hollow interior 218 of the power rod 215 may selectively engage the threaded portion of the drive shaft 207 in a threaded engagement.

The power rod 215 may include a coupling mechanism (e.g., slips, keys, or dogs) 209 that engages the guide housing 206 to rotationally fix the power rod 215 relative to the guide housing 206. In certain implementations, the power rod 215 may include a similar coupling mechanism (not shown) to engage the wellbore or an outerstring to stabilize its movement. In the embodiment shown in FIGS. 2A and 2B, the guide housing 206 has grooves 216 that engage the keys 209. A key block 210 is coupled to both the keys 209 and the ball nut assembly 211. The key block 210 moves linearly with the keys 209 but does not engage the guide housing 206. This arrangement prevents the keys 209, key block 210, and power rod 215 from moving rotationally when the drive shaft 207 is rotating but allows the keys 209, key block 210, power rod 215, and ball nut housing 220 to move linearly. In certain implementations, the keys 209 may be fixed to the key block 210 by one or more key screws 208.

Figure 2B:
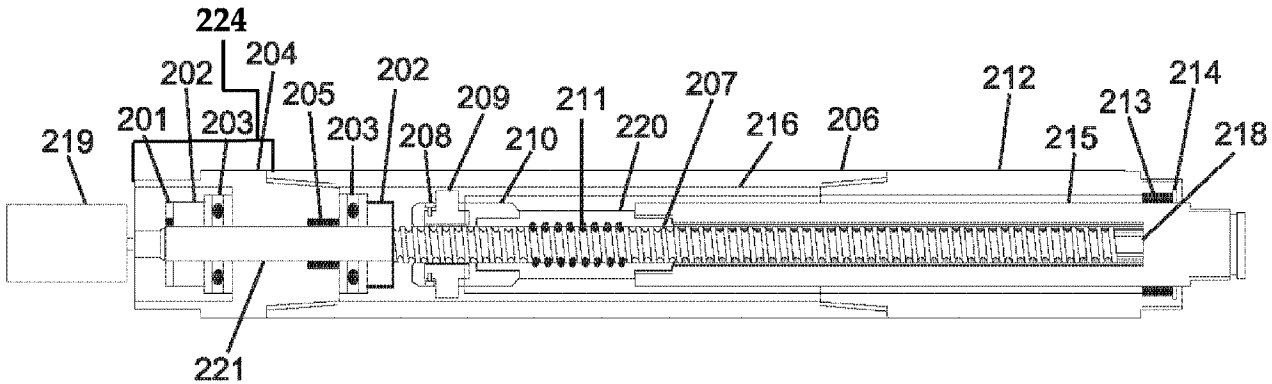
FIG. 2B depicts the DPU of FIG. 2A in a contracted position.

Accordingly, the rotation of the drive shaft 207 in a first direction may rotate the drive shaft out of the ball nut assembly 211, thereby extending the power rod 215 out of the DPU 200. Similarly, a rotation of the drive shaft 207 in the opposite direction may rotate the drive shaft 207 into the ball nut assembly 211, thereby retracting the power rod 215 back into the DPU 200. FIGS. 2A and 2B depict the power rod in its extended and retracted position, respectively.

The DPU 200 may be moved uphole and downhole by a conveying member (not shown) such as a slickline, a wireline, or coil tubing. In certain implementations, the conveying member may be coupled to the power section (not shown) of the DPU 200.

The motor 219 may be used to regulate rotation of the drive shaft 207. In certain embodiments, the motor 219 may be a direct current (DC) electric motor of any suitable type and it may be coupled to a self-contained power source, eliminating the need for power to be supplied from an exterior source, such as a source at the surface. As would be appreciated by those of ordinary skill in the art, having the benefit of this disclosure, any suitable power source may be used in conjunction with the motor 219. For example, in certain illustrative embodiments, the power source may include a battery assembly. In one implementation, battery assembly of the self contained power source may include a pack of one or more D-cell type alkaline batteries. Moreover, in certain illustrative embodiments, the motor 219 may be selectively activated and deactivated using a timer (not shown). Specifically, the timer may be set before the DPU 200 is directed downhole so that it will turn the motor 219 after a predetermined amount of time elapses. Additionally, the timer may be programmed to turn the motor 219 off after it has been on for a certain time period. As would be appreciated by those of ordinary skill in the art having the benefit of the present disclosure, any suitable timers may be used to control the operation of the motor 219. For instance, the timer may be a jumper timer or one of various types of rotary selection timers.

The hollow interior 218 of the power rod 215 may be designed to be able to engage other components therein. For instance, in certain embodiments the hollow interior 218 may include or be coupled to a threaded ball nut assembly 211. The motor 219 may be rotationally coupled to the drive shaft 207 so that energy generated by the motor 219 can be transferred to the drive shaft 207. The drive shaft 207 and the motor 219 may be coupled using any suitable coupling mechanism. For instance, in certain embodiments, a first end of the drive shaft 207 which is coupled to the motor 219 may include a square portion that aligns with and engages a socket on the motor shaft 221. Accordingly, the motor 219 may be rotationally coupled to the drive shaft 207. Further, as discussed above, a portion of the drive shaft 207 may be threaded. The threaded portion of the drive shaft may be received within the hollow interior 218 of the power rod 215 through the ball nut assembly 211. Accordingly, the drive shaft 207 may be coupled to the power rod 215 so that rotation of the drive shaft 207 is translated into a linear motion of the power rod 215.

Once the motor 219 is activated (i.e., turned on), the motor shaft 221 will rotate. Because the motor shaft 221 is coupled to the drive shaft 207, the rotation of the motor 219 will also rotate the drive shaft 207.

As the drive shaft 207 rotates in a pre-set direction, it moves into the hollow interior 218 of the power rod 215. When the drive shaft 207 reaches near the end of the hollow interior 218 of the power rod 215, the DPU 200 may be in a retracted position as shown in FIG. 2B. The keys 209 may reach a position where they may slide out of the grooves 216 on the guide housing 206, enabling the keys 209, key guide 210, ball nut housing 220, and power rod 215 to rotate with the rotation of the motor 219 and the drive shaft 207. This free rotation may be referred to as "freewheel" mode. This serves to prevent the drive shaft 207 from traveling any further downhole and protects the motor 219 from damage. Eventually, the motor 219 will time out and turn off.

The motor 219 may also be operated in the opposite direction so that the drive shaft 207 extends uphole out of the hollow interior 218 of the power rod 215. In this implementation, the grooves 216 on the guide housing 206 that engage the keys 209 may be configured so that a freewheel mode occurs when the tool is in an extended position. Specifically, the guide housing 206 may be configured so that the grooves 216 have openings on a downhole end thereof to permit the keys 209 to slide out of the grooves 216 of the guide housing 206 once the drive shaft 207 has reached its maximum extended position. Accordingly, in the same manner discussed above, in the maximum extended position the drive shaft 207 enters a freewheel position.

A plurality of retainer nuts 202 may be threaded onto an uphole end of the drive shaft 207. A retainer locking disk 201 may be threaded on the drive shaft 207 and is located uphole of the retainer nuts 202. The retainer nuts 202 ensure the drive shaft 207 does not become disengaged from the power rod 215 by rotating too far uphole. The retainer locking disk 201 may act to prevent the power rod 215 from moving from a predetermined stationary position. The retainer locking disk 201 may consist of any suitable structures known to those of ordinary skill in the art, having the benefit of the present disclosure. For instance, in certain illustrative embodiments, the locking disk 201 may include an allen screw or any type of bolt, or a threaded screw with a slot. Thrust bearings 203 may be threaded onto the uphole end of the drive shaft 207. Thrust bearings 203 may allow the drive shaft 207 to rotate under loads from either direction. When the motor 219 is operated, the retainer locking disk 201 and the retainer nuts 202 rotate with the drive shaft 207. The top sub-housing 204, the guide housing 206, and the lower housing 212 all move linearly but do not rotate.

In certain implementations, lubricating fluid may be provided in the hollow interior 218 of the power rod 215. Wellbore pressure may be great at certain depths, causing the drive shaft 207 to rotate at a speed that is undesirably high. When the motor 219 is activated, the motor shaft 221 begins to rotate. The pressure inside the wellbore acting on the cross sectional area of the drive shaft 207 is greater than the pressure in the hollow interior 218 of the power rod 215. The force applied to the power rod 215 is exerted to the drive shaft 207 which causes the drive shaft 207 to rotate at high speeds until external forces (i.e., the device being set) equal the forces applied to the power rod 215. At that point, the continued rotation of the motor 219 would continue to turn the drive shaft 207 to retract the power rod 215 until the setting procedure is complete. The fluid will provide resistance to the rotation of the drive shaft 207 to slow down the rotation speed of the drive shaft 207. As the drive shaft 207 enters the hollow interior 218 of the power rod 215, the lubricating fluid may be forced out along space around the ball nut assembly 211. This will also ensure that the ball nut assembly 211 is well lubricated. The appropriate amount of lubricating fluid to fill the hollow interior 218 of the power rod 215 may be measured in advance of the DPU 200 being lowered downhole.

Drive shaft seals 205 may operate to prevent fluid flow into the motor 219 and other circuitry in the power section of the DPU 200. Rod seals 213 may be used as backup seals to prevent fluid flow into the motor 219 and other circuitry if the drive shaft seals 205 fail. A spiral retainer ring 214 may be used to keep the rod seals 213 in place and prevent them from blowing out due to internal pressure. Other types of retainers may be used in place of the spiral retainer ring 214.

In certain implementations, a frictional braking system 224, similar to a disk brake or drum brake on a car, may be coupled to the top sub housing 204. The frictional braking system 224 may be another mechanism that may be used to slow the rotation of the drive shaft 207 and the motor 219.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A downhole power unit comprising:
- a motor;
- a drive shaft, coupled to the motor, and disposed within a guide housing; and
- a power rod comprising a hollow interior and a coupling mechanism that rotationally fixes the power rod to the guide housing,
- wherein the drive shaft selectively engages the hollow interior,
  - wherein rotation of the drive shaft extends the power rod linearly relative to the guide housing to an extended position, and wherein counter-rotation of the drive shaft retracts the power rod linearly relative to the guide housing to a retracted position, and
  - wherein a portion of the power rod extends outside the guide housing in the extended position, and
- wherein the power rod is operable to selectively engage a subsurface device to be positioned downhole.

2. The downhole power unit of claim 1, wherein the hollow interior of the power rod contains lubricating fluid.

3. The downhole power unit of claim 1, wherein the drive shaft further comprises a threaded portion.

4. The downhole power unit of claim 3, wherein the hollow interior of the power rod selectively engages the threaded portion of the drive shaft in a threaded engagement.

5. The downhole power unit of claim 1, further comprising:
- a plurality of ball nuts;
- wherein the motor operates to move the drive shaft rotationally, and wherein the drive shaft operates to move the ball nuts rotationally.

6. The downhole power unit of claim 1, wherein a plurality of seals prevent fluid from entering the motor.

7. The downhole power unit of claim 1, further comprising a frictional braking system, wherein the frictional braking system is operable to slow the rotation of the drive shaft and the motor.

8. The downhole power unit of claim 1, wherein the drive shaft is positioned in a guide housing having a groove, wherein the power rod comprises one or more keys operable to engage the groove, and wherein when the one or more keys disengage the groove the rotation of the drive shaft in the first direction does not move the power rod linearly from the first position to the second position.

9. The downhole power unit of claim 1, wherein the coupling mechanism is one of the following: a slip, a key, and a dog.

10. The downhole power unit of claim 1, wherein the power rod is disposed within the guide housing when the power rod is in a retracted position.

11. A method of setting a subsurface device in a wellbore, comprising:
- lowering a subsurface device and a downhole power unit (DPU) into a wellbore;
- operating a motor on board the DPU;
- rotating a drive shaft of the DPU into a hollow interior of a power rod of the DPU, wherein the drive shaft is disposed within a guide housing, and wherein the power rod comprises a coupling mechanism that rotationally fixes the power rod to the guide housing;
- translating the power rod to an extended position such that a portion of the power rod extends outside of the guide housing;

retracting the power rod of the DPU to a retracted position such that the power rod is disposed within the guide housing; and retrieving the DPU.

12. The method of claim 11, wherein the hollow interior of the power rod of the DPU contains lubricating fluid.

13. The method of claim 11, wherein the drive shaft of the DPU further comprises a threaded portion.

14. The method of claim 13, wherein the hollow interior of the power rod of the DPU selectively engages the threaded portion of the drive shaft in a threaded engagement.

15. The method of claim 11, further comprising:

rotating a plurality of ball nuts, wherein operating the motor causes the drive shaft to move rotationally, and rotation of the drive shaft causes the ball nuts to move rotationally.

16. The method of claim 11, wherein a plurality of seals prevent fluid from entering the motor.

17. The method of claim 11, further comprising:

operating a frictional braking system, wherein the frictional braking system is operable to slow the rotation of the drive shaft and the motor.

18. The method of claim 11, wherein the drive shaft is positioned in a guide housing having a groove, wherein the power rod comprises one or more keys operable to engage the groove, and wherein when the one or more keys disengage the groove the rotation of the drive shaft in the first direction does not move the power rod linearly from the first position to the second position.

* * * * *